US007771227B1

(12) United States Patent
Yu et al.

(10) Patent No.: US 7,771,227 B1
(45) Date of Patent: Aug. 10, 2010

(54) CIRCUIT BOARD CONNECTOR ASSEMBLY

(75) Inventors: Sheng-Nan Yu, Tu-Cheng (TW); Chung-Yu Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/385,772

(22) Filed: Apr. 20, 2009

(51) Int. Cl.
*H01R 31/08* (2006.01)

(52) U.S. Cl. ..... 439/510

(58) Field of Classification Search ..... 439/510, 439/65, 357, 512, 513
See application file for complete search history.

(56) References Cited

U.S. PATENT DOCUMENTS

RE28,637 E * 12/1975 Ploeger ..... 362/485
4,384,754 A * 5/1983 Douty et al. ..... 439/74
6,036,534 A * 3/2000 Hoyt et al. ..... 439/510
6,379,179 B2 * 4/2002 Shinohara ..... 439/510
7,488,200 B2 * 2/2009 Yamamoto et al. ..... 439/511

* cited by examiner

*Primary Examiner*—Phuong K Dinh
(74) *Attorney, Agent, or Firm*—Rosenberg, Klein & Lee

(57) ABSTRACT

A circuit board connector assembly adapted for connecting two printed circuit boards includes a receptacle connector having a receptacle insulating housing and two plug connectors each connected with the corresponding printed circuit boards and having a plug insulating housing. Two opposite ends of the plug insulating housing respectively define a holding cavity passing through a side surface thereof. The holding cavity is connected with the side surface by a slope. Two opposite ends of the receptacle insulating housing extend downward to respectively form two connecting arms spaced from each other. A free end of each of the connecting arms is bent inward to form a buckling portion. The printed circuit boards are electrically connected with each other by means of the plug connectors inserted into the receptacle connector. The buckling portions can be buckled into and slide out from the corresponding holding cavities along the corresponding slopes.

8 Claims, 6 Drawing Sheets

CIRCUIT BOARD CONNECTOR ASSEMBLY

BACKGROUND OF THE INVENTION

1. Field of the Invention

The present invention generally relates to a connector assembly, and more particularly to a circuit board connector assembly.

2. The Related Art

At present, many electronic devices have a plurality of printed circuit boards therein. The printed circuit boards are generally connected with each other by a circuit board connector assembly.

Referring to FIG. 8, a conventional circuit board connector assembly 3 adapted for connecting two printed circuit boards 4 is shown. The circuit board connector assembly 3 includes a receptacle connector 31 and two plug connectors 32. Each of the plug connectors 32 is soldered to the corresponding printed circuit board 4. The two printed circuit boards 4 are electrically connected with each other by means of the two plug connectors 32 being inserted into the receptacle connector 31. However, the plug connectors 32 and the receptacle connector 31 are engaged with each other only by means of plug terminals (not shown) of the plug connectors 32 abutting against corresponding receptacle terminals (not shown) of the receptacle connector 31, so the plug connectors 32 are apt to fall off the receptacle connector 31 under shaking. As a result, the signal transmission between the two printed circuit boards 4 is not firm. Therefore, a circuit board connector assembly capable of overcoming the foregoing problem is required.

SUMMARY OF THE INVENTION

An object of the present invention is to provide a circuit board connector assembly adapted for connecting two printed circuit boards. The circuit board connector assembly includes two plug connectors each connected with the corresponding printed circuit boards and a receptacle connector mated with and electrically connecting the two plug connectors. Each of the plug connectors has a plug insulating housing and a plurality of plug terminals disposed in the plug insulating housing for being soldered to the corresponding printed circuit board. The plug insulating housing has a plug base body. Two opposite ends of the plug base body respectively defines a holding cavity extending longitudinally and passing through a side surface thereof. The holding cavity is connected with the side surface by a slope. The receptacle connector includes a receptacle insulating housing and a plurality of receptacle terminals disposed in the receptacle insulating housing, and each electrically connecting the corresponding two plug terminals of the two plug connectors so as to form an electrical connection between the printed circuit boards. The receptacle insulating housing has a receptacle base body. Each of two opposite ends of the receptacle base body extends downward to form two connecting arms spaced from each other. A free end of each of the connecting arms is bent inward to form a buckling portion. The buckling portions can be buckled into and slide out from the corresponding holding cavities along the corresponding slopes.

As described above, the buckling portions of the receptacle base body are buckled into the corresponding holding cavities of the plug base bodies so that can prevent the plug connectors from falling off the receptacle connector and further remain a steady signal transmission between the two printed circuit boards.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
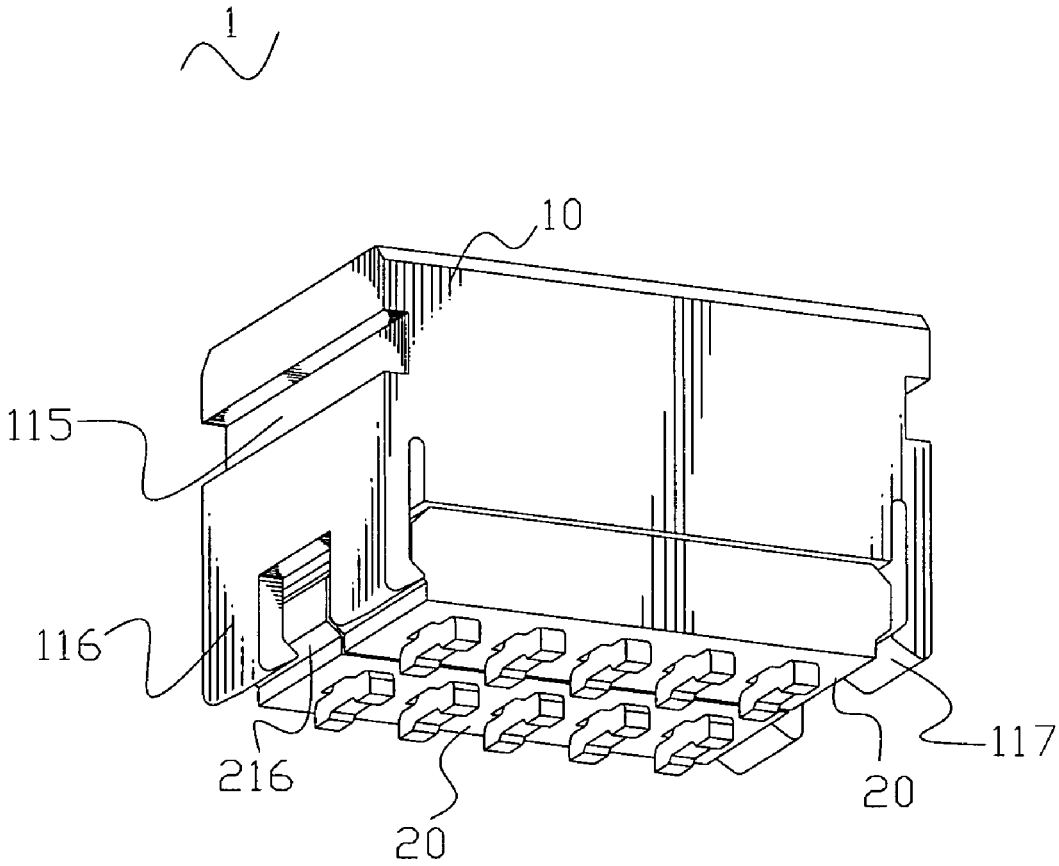
FIG. 1 is a perspective view of a circuit board connector assembly according to a first embodiment of the present invention.

With reference to FIG. 1, a circuit board connector assembly 1 according to a first embodiment of the present invention is shown. The circuit board connector assembly 1 includes a receptacle connector 10 and two plug connectors 20 mated with the receptacle connector 10.

Figure 2:
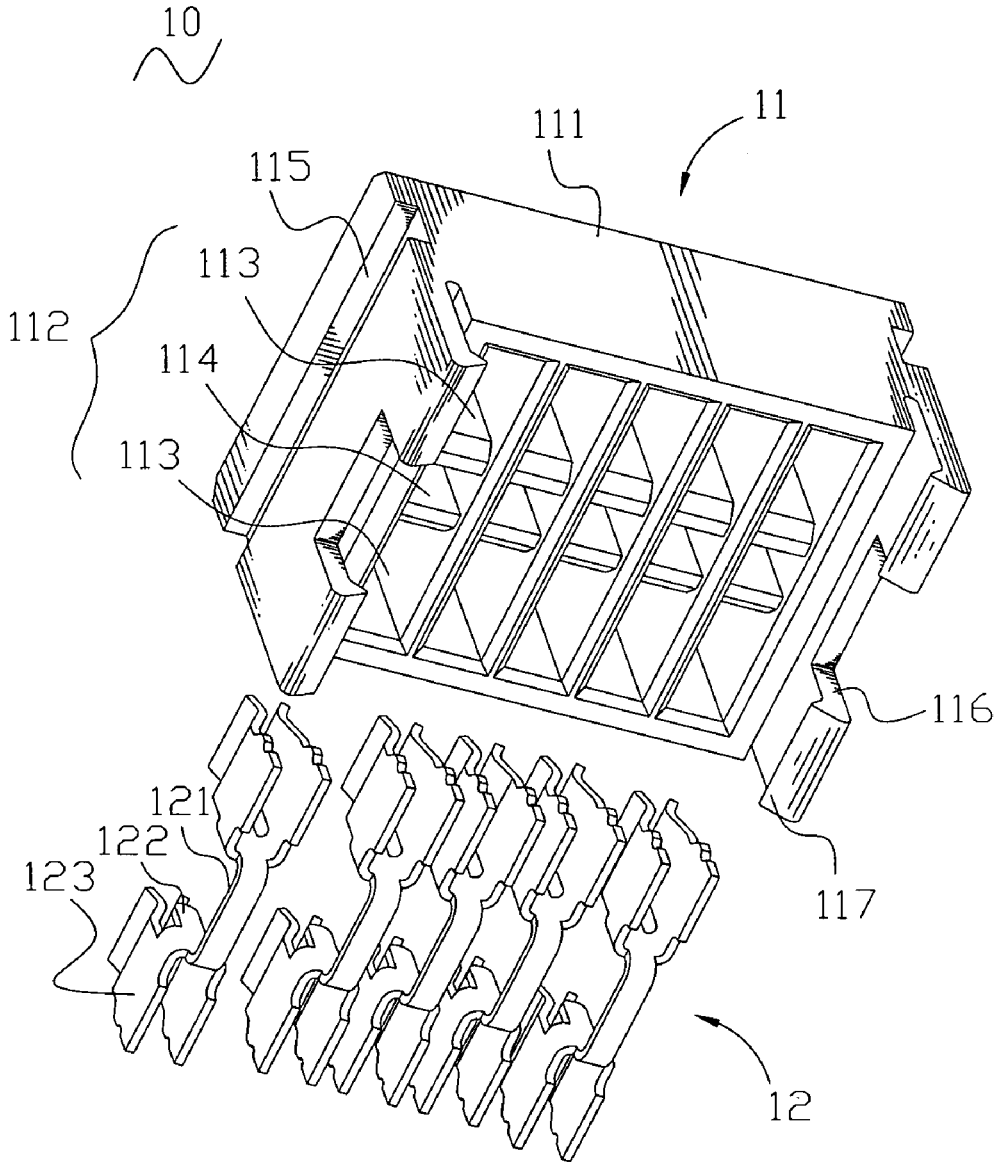
FIG. 2 is an exploded view of a receptacle insulating housing of the circuit board connector assembly of FIG. 1.

With reference to FIG. 2, the receptacle connector 10 includes a receptacle insulating housing 11 and a plurality of receptacle terminals 12 disposed in the receptacle insulating housing 11. The receptacle insulating housing 11 has a receptacle base body 111 of rectangular shape. A bottom of the receptacle base body 111 defines a plurality of receiving cavities 112 arranged at regular intervals along a longwise direction thereof and each extending longitudinally and vertically to pass through a bottom surface thereof. Each of the receiving cavities 112 includes two receiving grooves 113 at two ends thereof and a fixing groove 114 located between the two receiving grooves 113 and separated from the two receiving grooves 113 by two inner walls located therebetween. Two opposite side surfaces of the receptacle base body 111 respectively define an assisting channel 115 extending longitudinally. Two ends of a bottom of each of the side surfaces of the receptacle base body 111 extend downward to form a pair of connecting arms 116 spaced away from each other. A bottom end of each of the connecting arms 116 is bent inward to form a buckling portion 117 having a lying triangular prism shape and extending longitudinally.

Referring to FIG. 2 again, each of the receptacle terminals 12 has a rectangular base arm 121 extending longitudinally. Two opposite end s of the base arm 121 extend towards a same direction to form a pair of fixing portions 122. Two opposite side edges of each of the fixing portions 122 are connected with a pair of clamping portions 123 which extend opposite to the base arm 121 and face each other, respectively. Two ends of each pair of clamping portions 123 are face-to-face arched to approach each other. The two pairs of clamping portions 123 of each of the receptacle terminals 12 are formed by oppositely extending from the corresponding fixing portions 122.

When the receptacle connector 10 is assembled, the receptacle terminals 12 are received in the corresponding receiving cavities 112 of the receptacle insulating housing 11. The base arm 121 of the receptacle terminal 12 is disposed across a bottom of the corresponding fixing groove 114 to make the fixing portions 122 be received in the corresponding receiving grooves 113 and abut against a side of the corresponding inner sidewalls adjacent to the receiving grooves 113 so as to remain a firm combination between the receptacle terminal 12 and the receptacle insulating housing 11. The two pairs of clamping portions 123 are respectively received in the corresponding receiving grooves 113.

Figure 3:
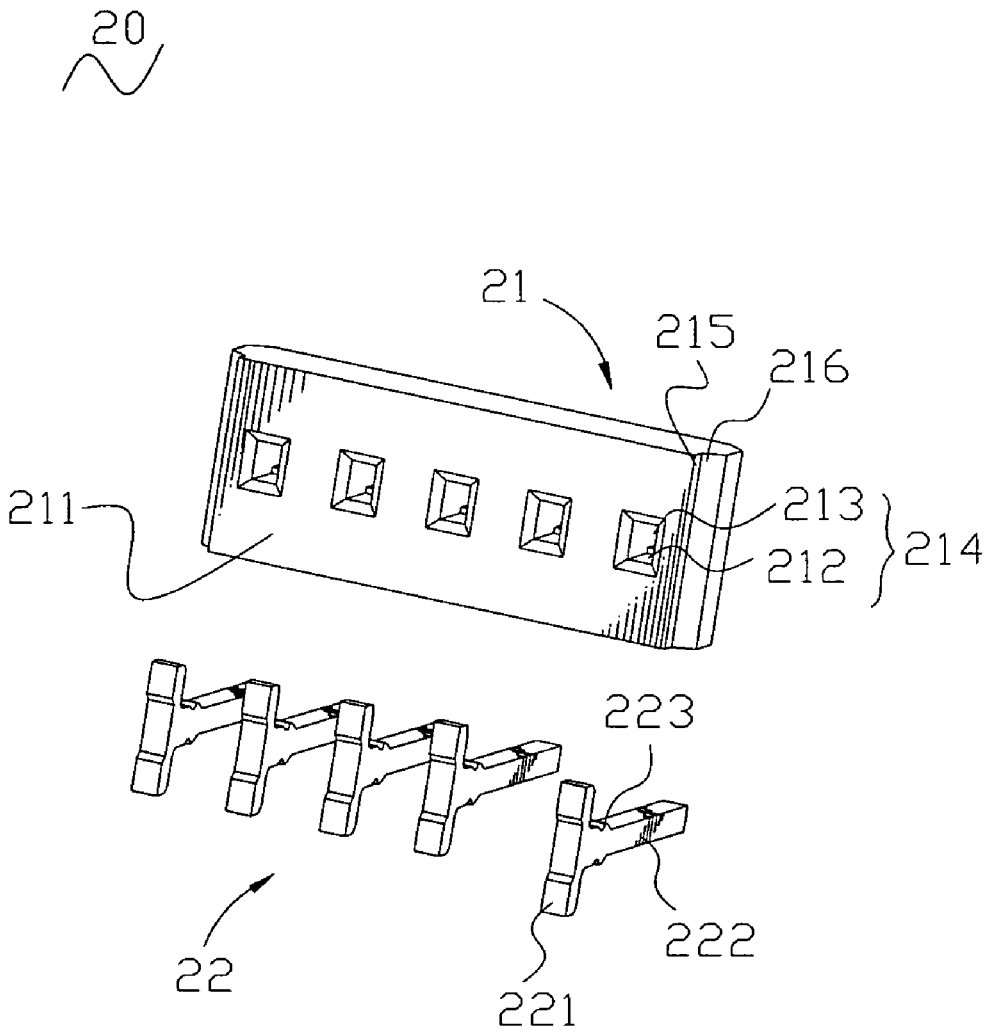
FIG. 3 is an exploded view of a plug insulating housing of the circuit board connector assembly of FIG. 1.

Referring to FIG. 3, each of the plug connectors 20 includes a plug insulating housing 21 and a plurality of plug terminals 22 disposed in the plug insulating housing 21. The plug insulating housing 21 has a rectangular plug base body 211. A middle of the plug base body 211 defines a plurality of holding fillisters 212 arranged at regular intervals along a longwise direction thereof and each passing through a bottom surface thereof. A middle of each of the holding fillisters 212 further extends upward to penetrate through a top surface of the plug base body 211 to form an inserting fillister 213. The inserting fillister 213 and the corresponding holding fillister 212 together define a terminal passageway 214. Two opposite ends of a bottom of the plug base body 211 respectively define a holding cavity 215 extending longitudinally and passing through a side surface thereof. The holding cavity 215 is smoothly connected with the corresponding side surface by a slope 216.

Referring to FIG. 3, each of the plug terminals 22 has a bar-shaped soldering portion 221 extending longitudinally. A middle of the soldering portion 221 extends perpendicularly to form a contacting arm 222. A portion of the contacting arm 222 adjacent to the soldering portion 221 oppositely protrudes outside to form two holding portions 223.

Figure 5:
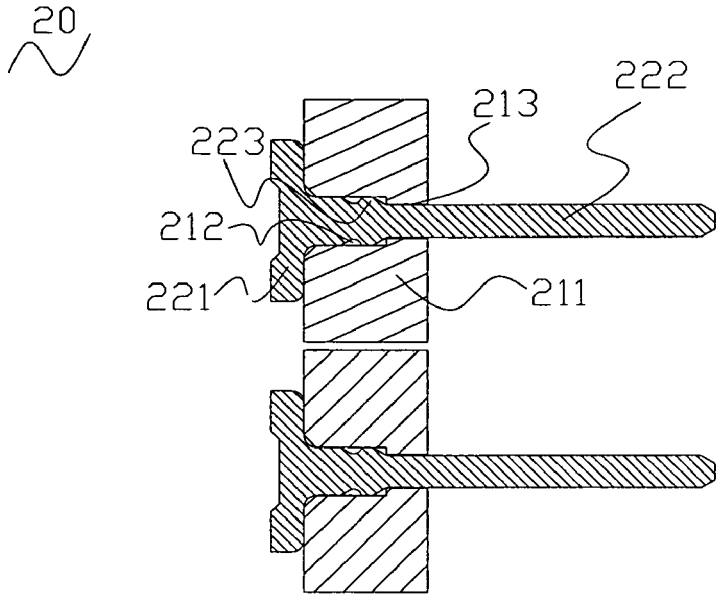
FIG. 5 is a cross-sectional view of the plug connector of the circuit board connector assembly of FIG. 1.

Referring to FIG. 5, when the plug connector 20 is assembled, the plug terminals 22 are respectively received in the terminal passageways 214 of the plug insulating housing 21. The holding portions 223 of the plug terminal 22 are held in the corresponding holding fillister 212. The contacting arm 222 is inserted in the corresponding inserting fillister 213 and partly stretches out of the top surface of the plug base body 211. The soldering portion 221 is against the bottom surface of the plug base body 211 for being soldered with a printed circuit board (not shown).

Figure 6:
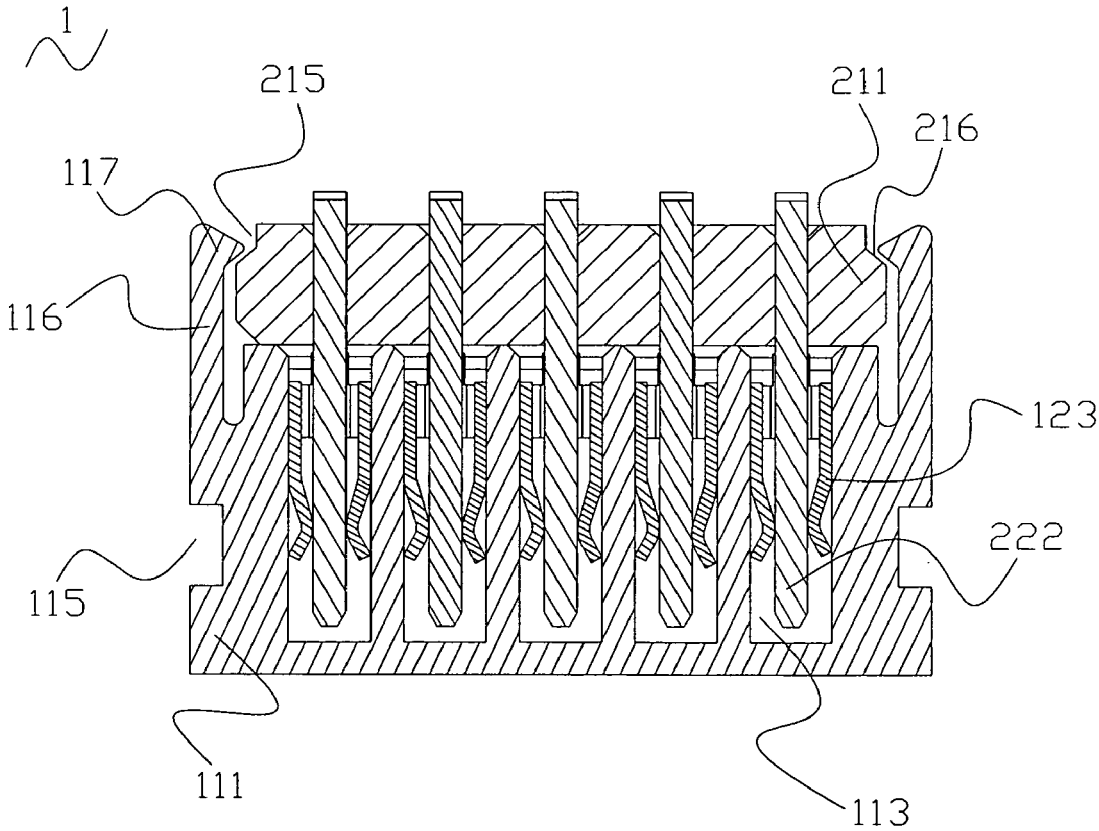
FIG. 6 is a cross-sectional view of the circuit board connector assembly according to the first embodiment of the present invention.

Referring to FIG. 1 and FIG. 6, when the two printed circuit boards respectively soldered with the corresponding plug connectors 20 are needed to transmit electrical signals with each other, the plug connectors 20 are respectively inserted into the receptacle connector 10. The contacting arm 222 of the plug terminal 22 is inserted into the corresponding receiving groove 113 of the receptacle connector 10 and electrically clamped by the clamping portions 123 of the corresponding receptacle terminal 12 so as to form an electrical connection between the plug connector 20 and the receptacle connector 10. Therefore, the two plug connectors 20 are electrically connected with each other by the receptacle connector 10 so that the electrical signals can be transmitted between the two printed circuit boards. Moreover, the buckling portion 117 is buckled into the corresponding holding cavity 215 so that remains a steady engagement of the receptacle connector 10 and the plug connectors 20.

When the receptacle connector 10 is mated with the plug connectors 20, the slope 216 can guide the corresponding buckling portion 117 to be easily buckled into and slide out from the corresponding holding cavity 215. Moreover, the operator can grapple the receptacle connector 10 by means of the assisting channels 115 so that facilitates the receptacle connector 10 to be pulled out of the plug connectors 20. The contacting arm 222 of the plug terminal 22 is clamped by the clamping portions 123 of the corresponding receptacle terminal 12. As a result, it not only can prevent the signal transmission between the receptacle connector 10 and the plug connectors 20 from breaking off, but also can allow a certain offset between the two printed circuit boards.

Figure 4:
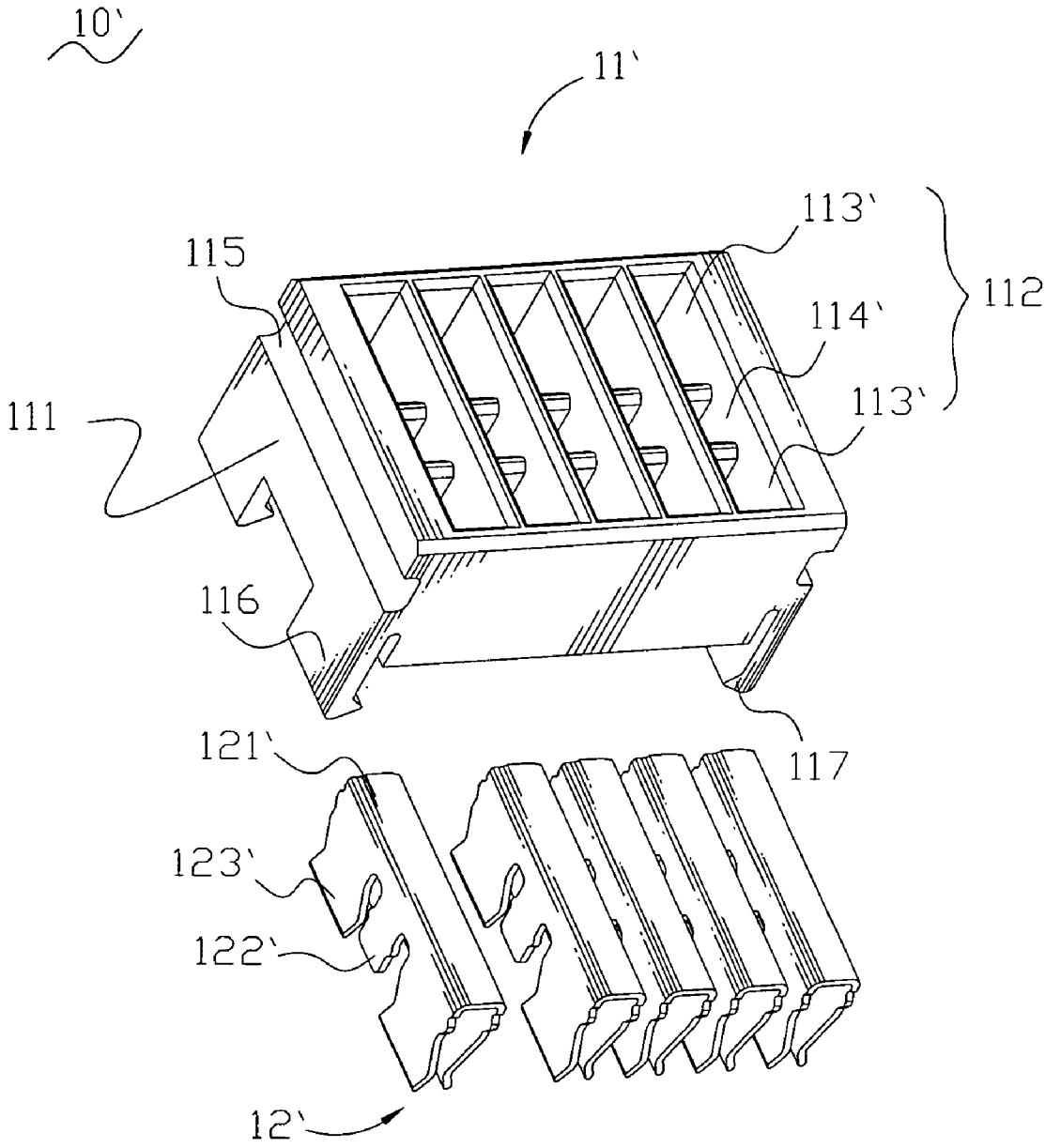
FIG. 4 is an exploded view of a receptacle insulating housing of a circuit board connector assembly according to a second embodiment of the present invention.
Figure 7:
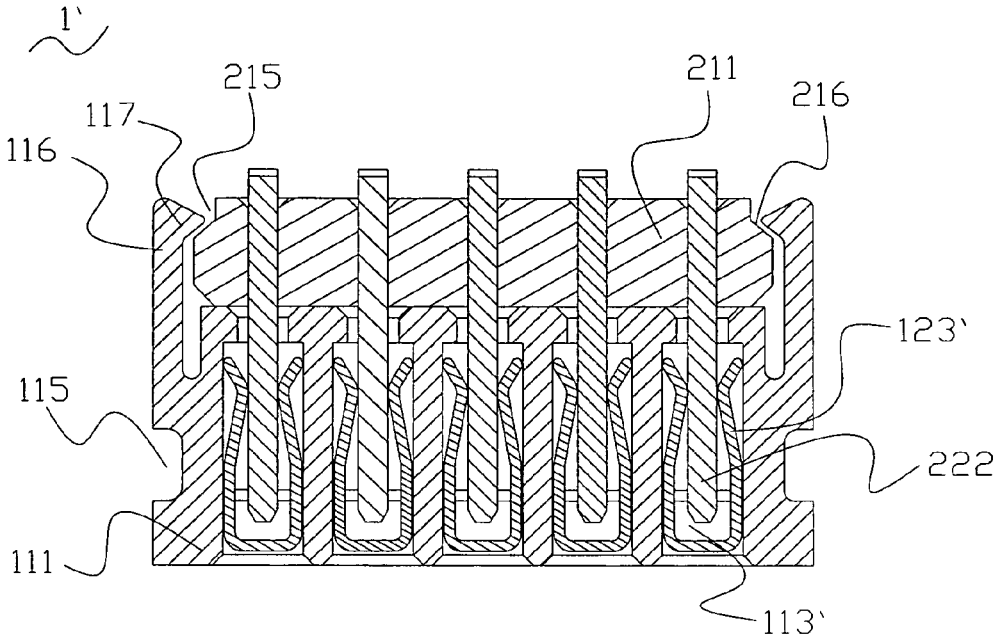
FIG. 7 is a cross-sectional view of the circuit board connector assembly according to the second embodiment of the present invention.
Figure 8:
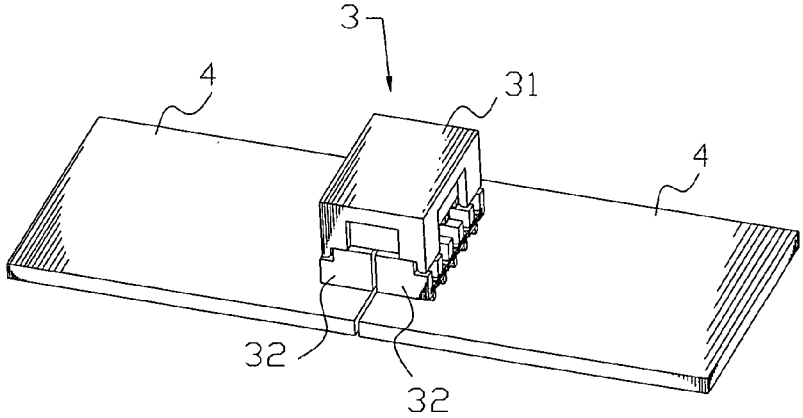
FIG. 8 (Prior Art)
FIG. 8 is a perspective view of a prior circuit board connector assembly connecting with two printed circuit boards.

Referring to FIG. 4 and FIG. 7, a circuit board connector assembly 1' according to a second embodiment of the present invention is shown. Comparing to the first embodiment, the difference is that a receptacle connector 10' of the circuit board connector assembly 1' is different from the receptacle connector 10 of the circuit board connector assembly 1 of the first embodiment. The difference therebetween will be described in detail hereinafter and the same construction between the circuit board connector assembly 1' and the circuit board connector assembly 1 will be omitted herefrom for simplicity and not be further described.

Referring to FIG. 4 and FIG. 7, the receptacle connector 10' includes a receptacle insulating housing 11' and a plurality of receptacle terminals 12'. Similar to the receptacle connector 10 of the circuit connector 1 of the first embodiment, the receptacle insulating housing 11' has the receptacle base body 111, the assisting channels 115, the connecting arms 116, the buckling portions 117 and a plurality of receiving cavities 112' each including two receiving grooves 113' and a fixing groove 114'. The difference therebetween is that each of the receiving cavities 112' further passes through a top surface of the receptacle base body 111 of the receptacle insulating housing 11'. Each of the receptacle terminals 12' has a rectangular base arm 121' extending longitudinally. Two opposite side edges of a middle of the base arm 121' extend towards a same direction to form a pair of fixing portions 122' facing each other. Two opposite side edges of each of two ends of the base arm 121' extend towards the same direction as the fixing portion 122' to form a pair of clamping portions 123' facing each other. Two distal ends of each pair of clamping portions 123' are face-to-face arched to approach each other. When the receptacle connector 10' is assembled, the receptacle terminals 12' are received in the corresponding receiving cavities 112' of the receptacle insulating housing 11'. The base arm 121' is disposed in a top of the corresponding receiving cavity 112'. The fixing portions 122' are fixed in the corresponding fixing groove 114' and the clamping portions 123' are received in the corresponding receiving grooves 113'. In the second embodiment, the receptacle terminal 12' is so designed that can allow a relative high current between the receptacle connector 10' and the plug connectors 20.

As described above, the buckling portions 117 of the receptacle base body 111 are buckled into the corresponding holding cavities 215 of the plug base bodies 211 so that can prevent the plug connectors 20 from falling off the receptacle connector 10, 10' and further remain a steady signal transmission between the two printed circuit boards.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A circuit board connector assembly adapted for connecting two printed circuit boards, comprising:

two plug connectors each connected with the corresponding printed circuit boards and including a plug insulating housing having a plug base body, two opposite ends of the plug base body respectively defining a holding cavity extending longitudinally and passing through a side surface thereof, the holding cavity being connected with the side surface by a slope, and a plurality of plug terminals disposed in the plug insulating housing for being soldered to the corresponding printed circuit board; and a receptacle connector mated with and electrically connecting the two plug connectors, the receptacle connector including a receptacle insulating housing having a receptacle base body, each of two opposite ends of the receptacle base body extending downward to form two connecting arms spaced away from each other, a free end of each of the connecting arms being bent inward to form a buckling portion extending longitudinally, and a plurality of receptacle terminals disposed in the receptacle insulating housing and each electrically connecting the corresponding two plug terminals of the two plug connectors so as to form an electrical connection between the printed circuit boards, wherein the buckling portions can be buckled into and slide out from the corresponding holding cavities along the corresponding slopes.

2. The circuit board connector assembly as claimed in claim 1, wherein each of the buckling portions has a lying triangular prism shape.

3. The circuit board connector assembly as claimed in claim 1, wherein two opposite side surfaces of the receptacle base body respectively define an assisting channel extending longitudinally.

4. The circuit board connector assembly as claimed in claim 1, wherein each of the plug terminals has a soldering portion and a contacting arm extended from the soldering portion, the plug base body of each of the plug connectors defines a plurality of terminal passageways each passing through a bottom surface and a top surface thereof, the contacting arm is inserted in the corresponding terminal passageway and partly stretches out of the top surface of the plug base body, and the soldering portion is against the bottom surface of the plug base body for being soldered with the corresponding printed circuit board.

5. The circuit board connector assembly as claimed in claim 4, wherein the contacting arm of each of the plug terminals protrudes oppositely outward to form a pair of holding portions adjacent to the soldering portion and abutting against inner surfaces of the corresponding terminal passageway.

6. The circuit board connector assembly as claimed in claim 4, wherein each of the receptacle terminals has a base arm, two opposite ends of the base arm extend towards a substantially same direction to form a pair of fixing portions, two opposite side edges of each of the fixing portions are connected with a pair of clamping portions which extend opposite to the base arm and face each other, the pair of clamping portions are further face-to-face arched to approach each other, the receptacle base body of the receptacle connector defines two rows of receiving grooves each passing through a bottom surface thereof, the fixing portions and the two pairs of clamping portions of each receptacle terminal are respectively received in the corresponding receiving grooves, the contacting arms of the corresponding two plug terminals of the two plug connectors are respectively electrically clamped by the clamping portions of the corresponding receptacle terminal.

7. The circuit board connector assembly as claimed in claim 4, wherein each of the receptacle terminals has a base arm, two opposite side edges of each of two ends of the base arm extend towards a substantially same direction to form a pair of clamping portions facing each other, the pair of clamping portions are further face-to-face arched to approach each other, the receptacle base body of the receptacle connector defines two rows of receiving grooves each passing through a bottom surface and a top surface thereof, the two pairs of clamping portions of each receptacle terminal are respectively received in the corresponding receiving grooves, the contacting arms of the corresponding two plug terminals of the two plug connectors are respectively electrically clamped by the clamping portions of the corresponding receptacle terminal.

8. The circuit board connector assembly as claimed in claim 7, wherein the two opposite side edges of the base arm of each of the receptacle terminals further extend towards a substantially same direction as the clamping portion to form a pair of fixing portions between the two pairs of clamping portions, the receptacle base body further defines a plurality of fixing grooves each disposed between the corresponding two receiving grooves, the fixing portions of each of the receptacle terminals are fastened in the corresponding fixing groove.

* * * * *